US007681973B2

(12) United States Patent
Uji et al.

(10) Patent No.: US 7,681,973 B2
(45) Date of Patent: Mar. 23, 2010

(54) INK JET PRINTING APPARATUS, INK JET PRINT HEAD, INK JET PRINTING METHOD, AND METHOD AND PROGRAM FOR SETTING PRINT CONDITIONS

(75) Inventors: Ayako Uji, Tokyo (JP); Yasushi Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 11/444,407

(22) Filed: Jun. 1, 2006

(65) Prior Publication Data

US 2006/0274100 A1 Dec. 7, 2006

(30) Foreign Application Priority Data

Jun. 3, 2005 (JP) ..... 2005-164451

(51) Int. Cl.
*B41J 29/38* (2006.01)

(52) U.S. Cl. ..... 347/13; 347/12; 347/19

(58) Field of Classification Search ..... 347/5, 347/9, 12, 13, 41–42
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 5,486,849 | A | 1/1996 | Miura et al. | |
| 5,847,722 | A * | 12/1998 | Hackleman | 347/19 |
| 6,412,903 | B1 * | 7/2002 | Lee et al. | 347/19 |
| 6,655,771 | B2 * | 12/2003 | Matsumoto et al. | 347/13 |
| 6,846,064 | B2 | 1/2005 | Yamane | |
| 2005/0122354 | A1 * | 6/2005 | Yamane et al. | 347/11 |
| 2006/0132519 | A1 * | 6/2006 | Kovacs | 347/12 |
| 2006/0279606 | A1 | 12/2006 | Jahana et al. | |

FOREIGN PATENT DOCUMENTS

| | | |
|---|---|---|
| JP | 59-123670 | 7/1984 |
| JP | 59-138461 | 8/1984 |
| JP | 5-57965 | 3/1993 |
| JP | 2003-305853 | 10/2003 |

* cited by examiner

*Primary Examiner*—Lam S Nguyen
(74) *Attorney, Agent, or Firm*—Fitzpatrick, Cella, Harper & Scinto

(57) ABSTRACT

In manufacturing a long ink jet print head in which a plurality of chips are arranged, a decrease in yield resulting from inappropriate arrangement of the chips can be suppressed and high-quality images can be printed. An image corresponding to the joining portion between adjacent chips is printed by using, as overlapping nozzles, those of the nozzles located in the joining portion which are selected on the basis of the amount of misalignment between chips.

14 Claims, 18 Drawing Sheets

| | |
|---|---|
| NOZZLE(n) | DATA (m) |
| NOZZLE(n+1) | DATA (m+1) |
| NOZZLE(n+2) | DATA (m+2) |
| NOZZLE(n+3) | DATA (m+3) |
| NOZZLE(n+4) | DATA (m+4) |
| NOZZLE(n+5) | DATA (m+5) |
| NOZZLE(n+6) | DATA (m+6) |
| NOZZLE(n+7) | DATA (m+7) |
| NOZZLE(n+8) | DATA (m+6) |
| NOZZLE(n+9) | DATA (m+7) |
| NOZZLE(n+10) | DATA (m+8) |
| NOZZLE(n+11) | DATA (m+9) |
| NOZZLE(n+12) | DATA (m+10) |
| NOZZLE(n+13) | DATA (m+11) |
| NOZZLE(n+14) | DATA (m+12) |
| NOZZLE(n+15) | DATA (m+13) |

SAME IMAGE DATA

SAME IMAGE DATA

FIG.5

INK JET PRINTING APPARATUS, INK JET PRINT HEAD, INK JET PRINTING METHOD, AND METHOD AND PROGRAM FOR SETTING PRINT CONDITIONS

BACKGROUND OF THE INVENTION

1. Field of the Invention

The present invention relates to a long ink jet print head in which a plurality of relatively short nozzle chips provided with nozzles are precisely arranged (what is called a joined head), an ink jet printing apparatus that prints images using this ink jet print head, an ink jet printing method, and a method and program for setting print conditions.

2. Description of the Related Art

The following printing apparatuses are configured to print images (including characters and symbols) on print media such as sheets, thin plastic plates, or the like: those which are used for printers, copiers, and the like or which are used as composite electronic equipment including a computer, a word processor, or the like as well as output equipment such as a workstation. These printing apparatuses can be classified into an ink jet type, a wire dot type, and a laser beam type according to a printing system.

Serial type printing apparatuses perform a printing operation while moving printing means (print head) in a main scanning direction crossing a direction in which a print medium is conveyed (sub-scanning direction). Every time the printing means finishes the printing operation for one main scan, the print medium is conveyed by a predetermined amount in the sub-scanning direction. Images are sequentially printed on the print medium by repeating the printing operation and a conveying operation of conveying the print medium as described above.

What is called a line type printing apparatus carries out printing while conveying the print medium in the sub-scanning direction without moving the printing means in the main scanning direction.

Ink jet printing apparatuses carries out printing by allowing an ink jet print head serving as printing means to eject ink to the print medium. Such an ink jet printing apparatus has the advantages of facilitating a reduction in the size of the ink jet print head, enabling high-definition images to be printed at high speed, enabling what is called ordinary paper to be printed without any special treatment to reduce running costs, reducing noise by using a non impact system, and facilitating the use of arrangements for forming color images using multicolor inks. In particular, an ink jet printing apparatus using what is called a full-multi type ink jet print head enables a further increase in the speed of image formation; the full-multi type ink jet printing apparatus has a large number of nozzles (ink ejection openings) arranged in a direction orthogonal to the print medium conveying direction. Much attention is being paid to this type of ink jet printing apparatus because it is expected to be used for on-demand printing, the need of which has recently been growing.

In contrast to printing of newspapers or magazines, which involves several million copies per printing process, the on-demand printing need not achieve a print speed corresponding to hundred thousand copies per hour. However, it has been desired to reduce labor required for the on-demand printing. The line type ink jet printing apparatus using the full-multi type print head achieves a lower print speed than conventional offset printing apparatuses. However, this type of ink jet printing apparatus eliminates the need to produce printing plates to enable a reduction in required labor and is thus optimum for the on-demand printing.

The line type ink jet printing apparatus using the full-multi type print head needs to provide a resolution of 600×600 dpi (dots/inch) in order to print monochromatic images such as texts. It needs to provide a high resolution of at least 1,200×1,200 dpi in order to print full color images such as photographs. It also needs to achieve a print speed corresponding to 30 pages per minute for A3-sized print media.

On the other hand, images taken with a digital camera or the like may be printed on L-sized print media as is the case with the prior art or on small print media such as postcards. Thus, images are very often printed on print media of different sizes.

However, for the full-multi type ink jet print head, it is difficult to machine, without any defects, all of a large number of ejection openings arranged across the width of a print area on the print medium and all elements (ink jet print elements) required to eject ink from the ejection openings. For example, a full-multi type print head used to print photographic images on large-sized sheets in, for example, offices requires about 14,000 ejection openings (print width: about 280 mm) in order to print images on A3-sized sheets at a resolution of 1,200 dpi. It is difficult to machine, without any defects, all ink jet print elements corresponding to the large number of ejection openings. Given that such print heads free from any defects can be manufactured, their efficiency percentage is very low and their manufacture costs are enormous.

Thus, a configuration using what is called a joined head has been proposed for the line type ink jet printing apparatus. The joined head is a long print head formed by precisely arranging a plurality of relatively inexpensive, short chips for print heads used for the serial type ink jet printing apparatus. However, with the joined head, image density is disadvantageously likely to be uneven in printed images corresponding to the joining portions among the plurality of chips. Specifically, if misalignment occurs between the arrays of nozzles (ejection openings) in the adjacent chips, the nozzle pitch in the joining portion between the chips is different from that in the other parts. This may result in a stripe-like high- or low-density portion (joining stripe) on a printed image.

Several improvements have been proposed to prevent generation of joining stripes due to the joined head.

For example, the following have been proposed: a method of precisely arranging the joining portions among the chips and a method of using an arranging device to reduce a variation in nozzle pitch (Japanese Patent Application Laid-Open No. 2003-305853), that is, a method of improving the physical machining precision of the print head. A method has also been proposed which, rather than simply arranging the adjacent chips so that nozzles located at the ends of the respective nozzle lines are adjacent to each other in the direction of the nozzle lines, arranges the adjacent chips so that two sets of a plurality of nozzles located close to the ends of the respective nozzle lines overlap each other (Japanese Patent Application Laid-Open No. 05-057965). During a printing operation, the overlapping nozzles eject ink so as to make possible joining stripes unnoticeable. A method has also been proposed which varies the amount of ink ejected from nozzles located in the joining portion between the chips so as to make possible joining stripes unnoticeable.

However, even with the above measures for suppressing the occurrence of joining stripes, if the array of a plurality of chips becomes defective during a process of manufacturing print heads, suppressing the occurrence of joining strips is difficult. Thus, if long print heads are manufactured by arranging a large number of chips, even when a defect occurs in only one of the joining portions among the chips, that print head as a whole must be rejected. This reduces the yield of print heads. Moreover, the improved precision of a device for arranging a plurality of chips increases manufacture costs. If image processing is executed to control printing depending on the misalignment in the joining portion between the chips, separate means are required for determining the amount of misalignment on the basis of a printed test pattern.

SUMMARY OF THE INVENTION

An object of the present invention is to provide an ink jet print head which, when a long ink jet print head is manufactured by arranging a plurality of chips, enables the suppression of a decrease in yield caused by the misalignment between the chips, the print head also being able to print high quality images, as well as an ink jet printing apparatus and method for printing images using this ink jet print head, a method for setting print conditions, and a program.

Another object of the present invention is to simplify image processing of an image corresponding to the joining portion between chips.

In a first aspect of the present invention, there is provided an ink jet printing apparatus that prints an image by using a print head having a plurality of chips each comprising a plurality of nozzles which are arranged in a line and from which ink can be ejected, predetermined sets of nozzles in a joining potion between two adjacent chips overlapping each other, to move the ink jet print head and a print medium relative to each other in a direction crossing a direction in which the nozzles are arranged, the apparatus comprising:

control means for printing an image corresponding to the joining portion between the two adjacent chips by using, as the overlapping nozzles, those of the nozzles located in the joining portion which are selected on the basis of the amount of misalignment among the plurality of chips.

In a second aspect of the present invention, there is provided an ink jet print head having a plurality of chips each comprising a plurality of nozzles which are arranged in a line and from which ink can be ejected, predetermined sets of nozzles in a joining potion between two adjacent chips overlapping each other, the print head comprising:

storage means capable of storing information on the amount of misalignment among the plurality of chips as information required to select overlapping nozzles from the nozzles located in the joining portion between the two adjacent chips, the overlapping nozzles being used to print an image corresponding to the joining portion.

In a third aspect of the present invention, there is provided an ink jet printing method of printing an image by using a print head having a plurality of chips each comprising a plurality of nozzles which are arranged in a line and from which ink can be ejected, predetermined sets of nozzles in a joining potion between two adjacent chips overlapping each other, to move the ink jet print head and a print medium relative to each other in a direction crossing a direction in which the nozzles are arranged, the method comprising the step of:

printing an image corresponding to the joining portion between the two adjacent chips by using, as the overlapping nozzles, those of the nozzles located in the joining portion which are selected on the basis of the amount of misalignment among the plurality of chips.

In a fourth aspect of the present invention, there is provided a method for setting print conditions for image printing carried out by using a print head having a plurality of chips each comprising a plurality of nozzles which are arranged in a line and from which ink can be ejected, predetermined sets of nozzles in a joining potion between two adjacent chips overlapping each other, to move the ink jet print head and a print medium relative to each other in a direction crossing a direction in which the nozzles are arranged, the method comprising the step of:

setting, as the overlapping nozzles, those of the nozzles located in the joining portion between the two adjacent chips which are selected on the basis of the amount of misalignment among the plurality of chips.

In a fifth aspect of the present invention, there is provided a program for setting print conditions for image printing carried out by using a print head having a plurality of chips each comprising a plurality of nozzles which are arranged in a line and from which ink can be ejected, predetermined sets of nozzles in a joining potion between two adjacent chips overlapping each other, to move the ink jet print head and a print medium relative to each other in a direction crossing a direction in which the nozzles are arranged, the program allowing a computer to execute:

a step of setting, as the overlapping nozzles, those of the nozzles located in the joining portion between the two adjacent chips which are selected on the basis of the amount of misalignment among the plurality of chips.

In the present specification, the meaning of the terms "print" and "printing" is not limited to formation of meaningful information such as letters and figures. For example, the terms "print" and "printing" also commonly refer to formation of an image, a pattern, or the like on a print medium or processing of a medium regardless of whether or not the image or the like is meaningful and whether or not the image or the like is formed so as to be visible to human beings.

The term "print media" not only refers to paper, used in common ink jet printing apparatuses, but also refers commonly to materials such as clothes, plastic films, and metal plates which can receive ink ejected by a head.

The term "ink" should be broadly interpreted as is the case with the definition of the terms "print" and "printing". It refers to a liquid which is applied to a print medium to form an image, a pattern, or the like or which can be used to process a medium.

If printing is performed using a long ink jet print head in which a plurality of chips each comprising a plurality of nozzles are arranged, the present invention selects nozzles used to print an image corresponding to the joining portion between the chips, depending on the misalignment between the chips. This enables high-grade images to be printed even with an ink jet print head with misaligned chips.

Processing of an image corresponding to the joining portion between chips can be simplified by pre-measuring and storing the amount of misalignment between the chips.

Since high-grade images can be printed even with an ink jet print head with misaligned chips, the yield of the ink jet print head can be increased. This enables the inexpensive provision of a long ink jet print head and an ink jet printing apparatus using this print head.

The above and other objects, effects, features and advantages of the present invention will become more apparent from the following description of embodiments thereof taken in conjunction with the accompanying drawings.

BRIEF DESCRIPTION OF THE DRAWINGS

FIG. 5 is a diagram showing the correspondence between the nozzles in the joining portion in the print head in FIG. 4 and image data;

DETAILED DESCRIPTION OF THE PREFERRED EMBODIMENTS

Embodiments of the present invention will be described below with reference to the drawings.

First Embodiment

Figure 1:
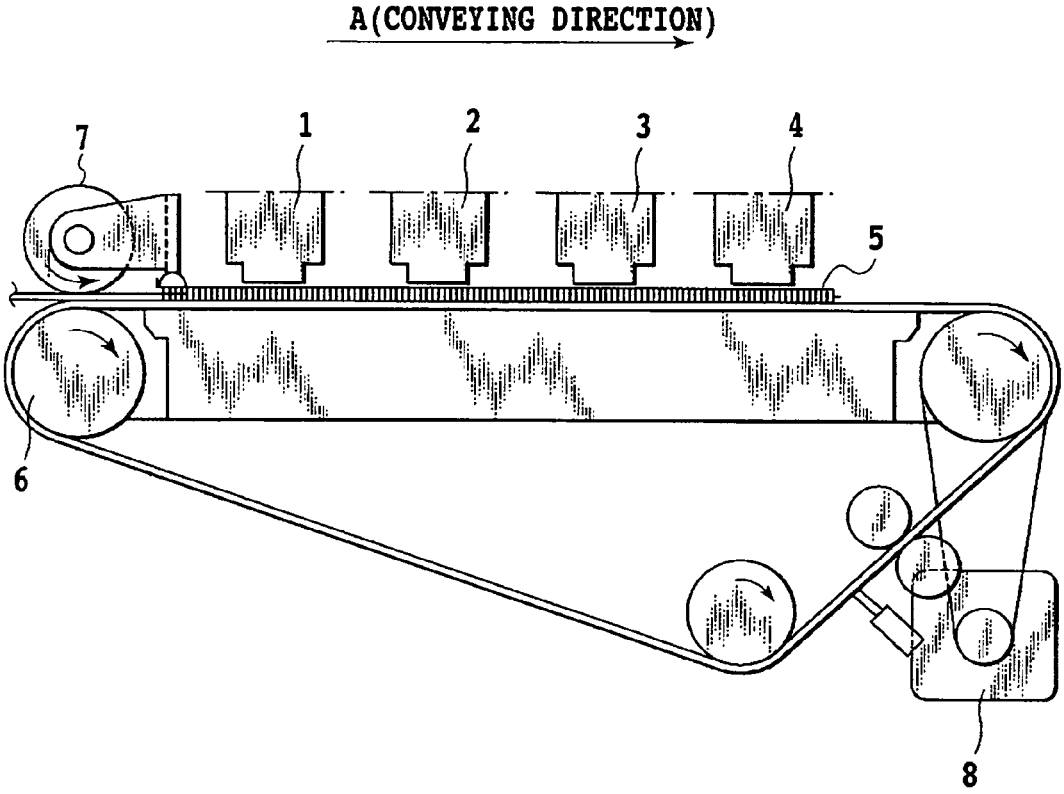
FIG. 1 is a schematic diagram showing the configuration of an ink jet printing apparatus in accordance with a first embodiment of the present invention.

FIG. 1 is a side view illustrating the general configuration of an ink jet printing apparatus in accordance with a first embodiment of the present invention.

Long ink jet print heads 1, 2, 3, and 4 constitute a head unit. A plurality of ink ejection openings are arranged in each of the print heads to eject ink. The print heads 1, 2, 3, and 4 are long ink jet print heads that eject black (K), cyan (C), magenta (M), and yellow (Y) inks. Each of the print heads is supplied with ink through an ink supply tube (not shown). Moreover, control signals and the like are sent to each print head via a flexible cable (not shown). A print medium 5 such as ordinary paper, high-grade dedicated paper, an OHP sheet, glossy paper, a glossy film, or a postcard is sandwiched between a conveying roller 6 and a sheet pressing roller 7 and driven by a drive motor 8. The print medium 5 is thus fed in the direction of arrow A (conveying direction).

Liquid paths that are in communication with the ink ejection openings are formed in each print head and provided with heating elements (electrothermal energy converters) that generate thermal energy required to eject ink. By driving the heating elements in accordance with read timings for a linear encoder (not shown) on the basis of print signals, it is possible to eject ink droplets to the print medium so that the ink droplets adhere to the print medium, thus printing an image.

A position control section (not shown) capable of controlling the position of the print head can adjust the movement of each print head via a control motor and a moving belt (not shown). In other words, the position control section can move each print head by operating the control motor depending on the width of an image to be printed or the size of the print medium.

While the print head is inoperative, capping means (not shown) comprising a cap portion closes an ink ejection opening surface (surface on which the ink ejection openings are formed) of the print head. This prevents the fixture of ink caused by evaporation of an ink solvent and the blockage of the ink ejection openings with foreign matter such as dust sticking to the ink ejection openings. The capping means is also utilized to avoid inappropriate ejections from ink ejection openings with low print frequencies or their blockage. Specifically, ink that does not contribute to image printing can be ejected from the ejection openings to the cap portion (dummy ejection). Ink can also be sucked and discharged into the cap portion through the ink ejection openings by introducing a negative pressure from a pump (not shown) into the cap portion while it is capping the ink ejection opening surface. As stated above, the capping means is also utilized to recovery the ink ejecting condition of the ink ejection openings. A blade or a wiping member (not shown) can also be placed adjacent to the cap portion to clean the ink ejection portion formed surface of the print head.

Figure 2:
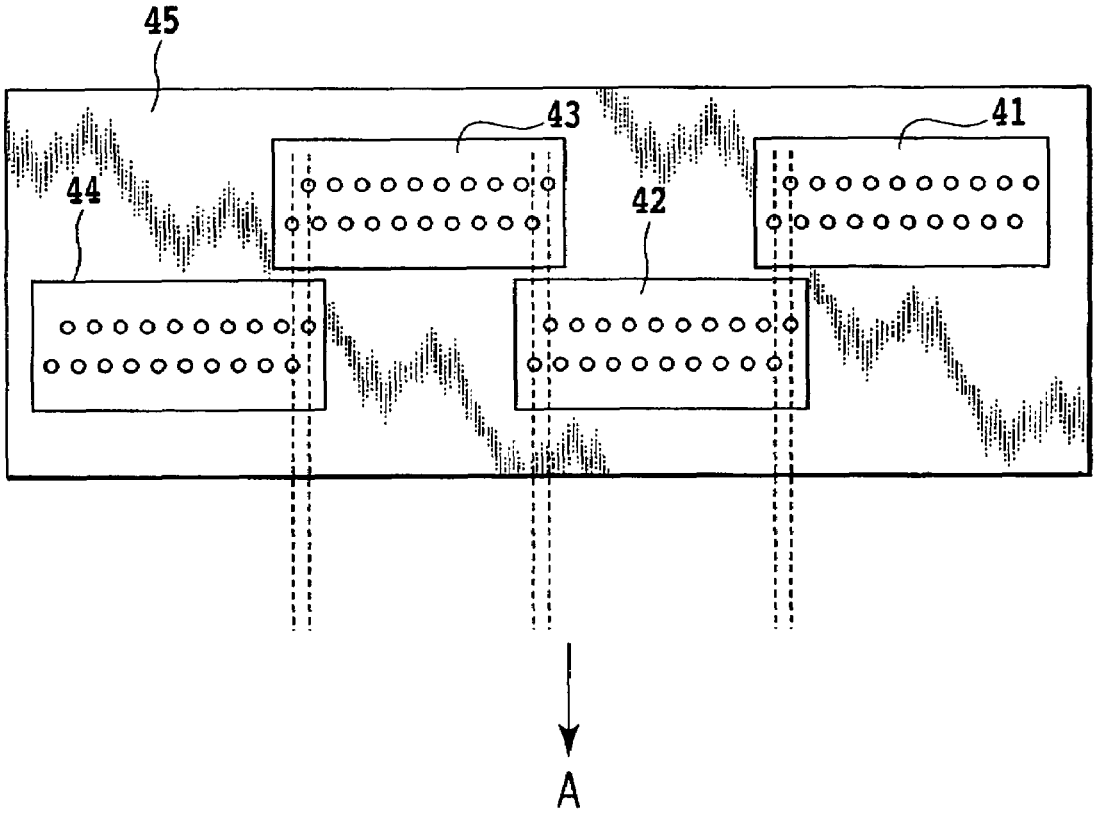
FIG. 2 is a schematic diagram of a full-multi type long print head used for the ink jet printing apparatus in FIG. 1.

FIG. 2 is a diagram illustrating an example of configuration of a full-multi type long print head used for this printing apparatus. The print head in the present example includes a plurality of (in the present example, four) chips 41, 42, 43, and 44 each having relatively short nozzle line groups (group of nozzle lines each having a small number of nozzles). The chips 41, 42, 43, and 44 are staggered in the direction of the nozzle lines, to form a single long nozzle group unit 45. The relatively short chips 41 to 44 are arranged so that two sets of at leas two (in the present embodiment, two) nozzles located at the ends of the nozzle groups overlap each other (these nozzles are referred to as "end nozzles" below). Ink droplets ejected from the overlapping nozzles can impact the same print matrix if the print head and the print medium move relative to each other during a printing operation.

Figure 3:
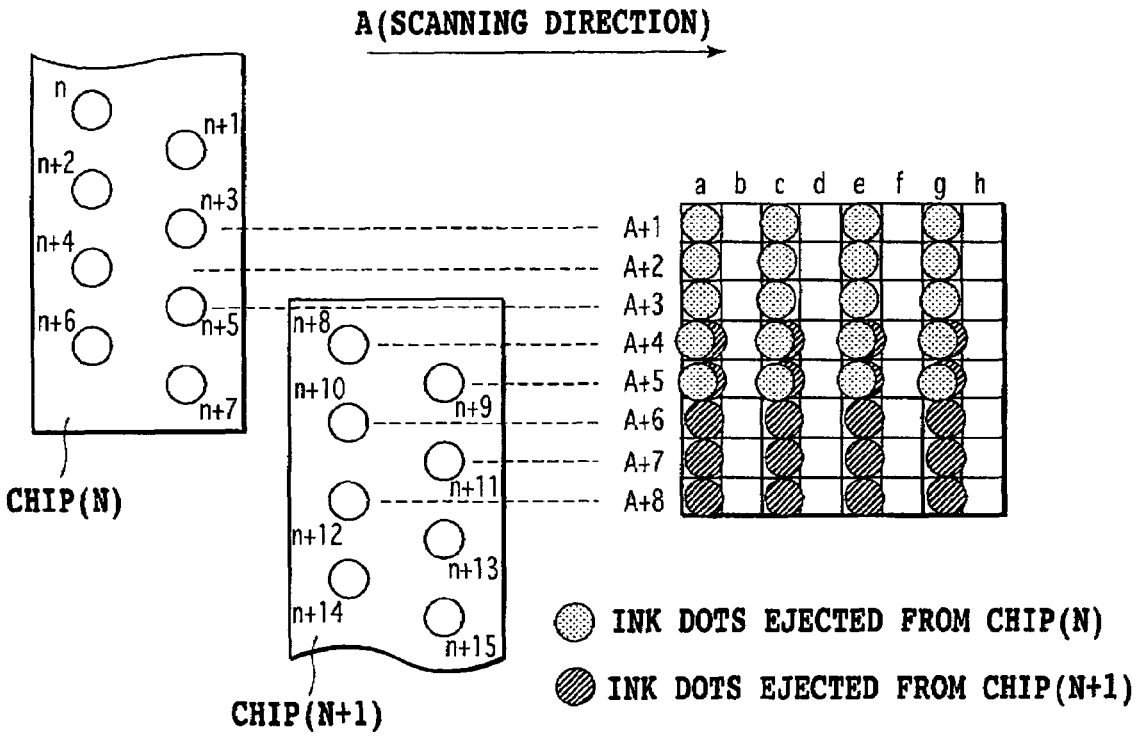
FIG. 3 is a diagram showing the relationship between nozzles in a joining portion in the print head in FIG. 2 and positions where ink dots are formed.

In FIG. 3, nozzles (n+6) and (n+7) in a chip N overlap nozzles (n+8) and (n+9) in a chip (N+1). In this case, ink droplets ejected from the overlapping nozzles (n+6) and (n+8) can impact (A+4, *a*), (A+4, *c*), (A+4, *e*), and (A+4, *g*) on the print matrix. Similarly, ink droplets ejected from the overlapping nozzles (n+7) and (n+9) can impact (A+5, *a*), (A+5, *c*), (A+5, *e*), and (A+5, *g*) on the print matrix.

Figure 4:
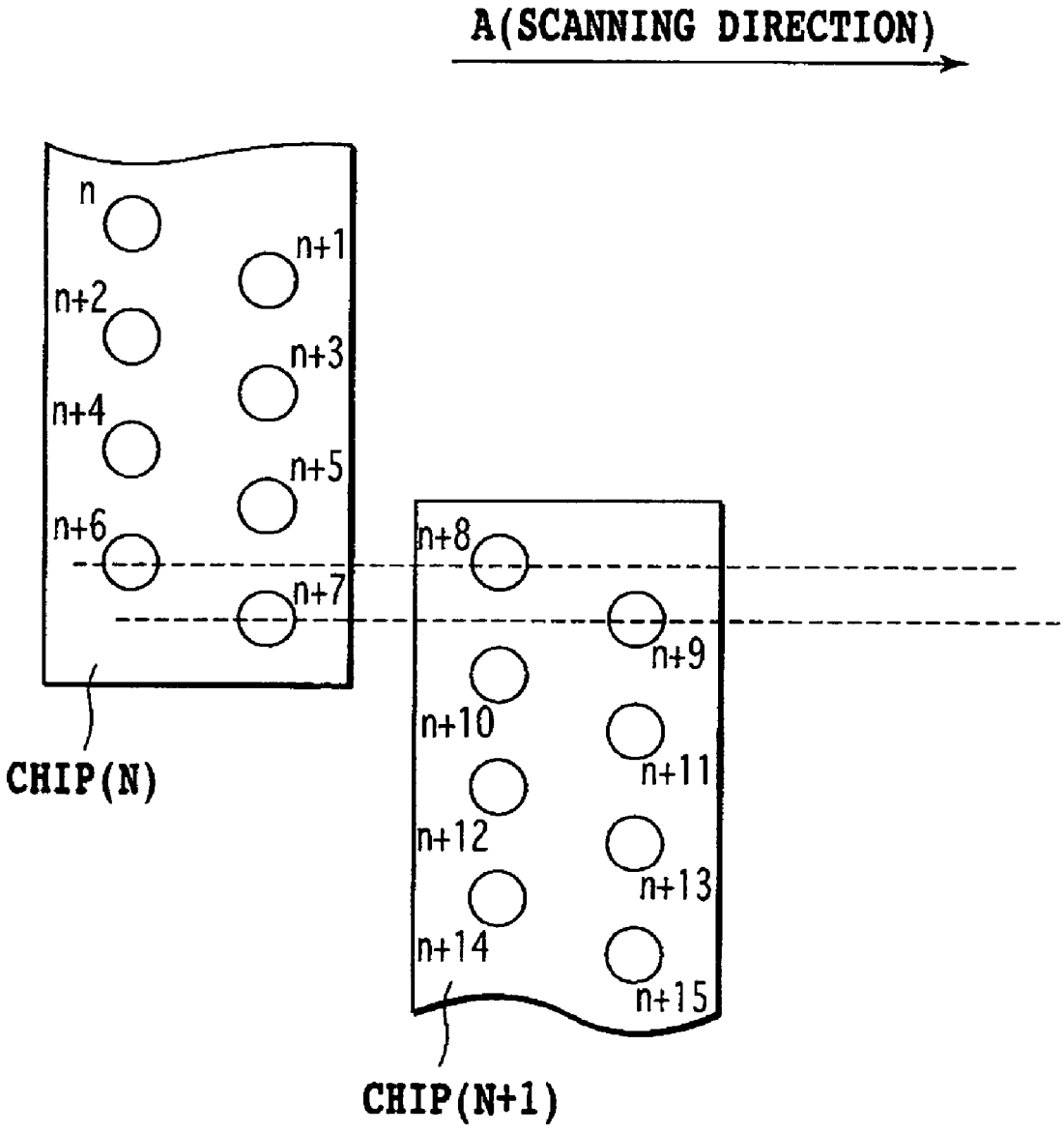
FIG. 4 is a schematic diagram showing that no misalignment occurs in the joining portion in the print head in FIG. 3.

As is apparent from FIG. 4, the relative positional relationship between the overlapping nozzles is such that these nozzles allow the same image to be printed in the scanning direction of the arrow A. FIG. 4 shows that no misalignment occurs between the nozzle lines. Specifically, the nozzles (n+6) and (n+8) enable dots to be formed on the same print line in the scanning direction. Similarly, the nozzles (n+7) and (n+9) enable dots to be formed on the same print line in the scanning direction.

FIG. 5 schematically shows the relationship between the nozzles in FIG. 4 and image data. As is apparent from FIG. 5, the overlapping nozzles are supplied with the same image data.

Figure 6:
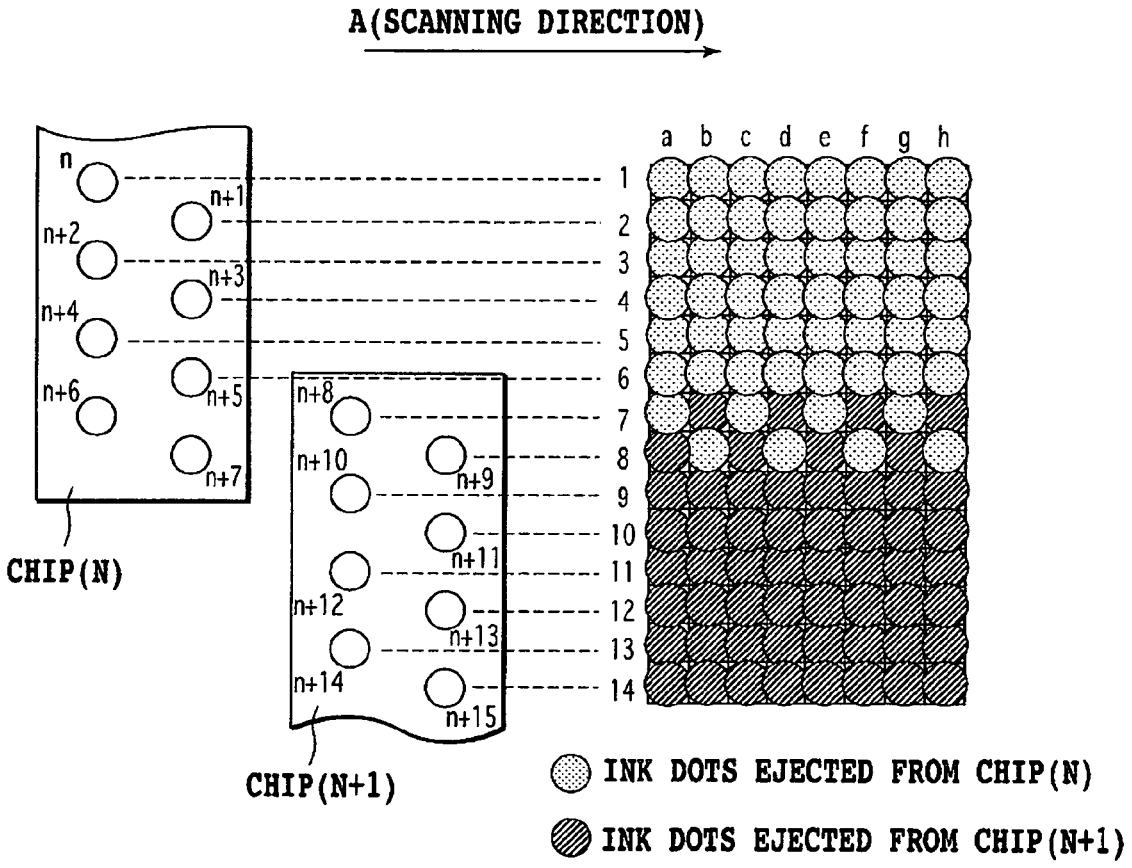
FIG. 6 is a diagram showing the relationship between the nozzles in the joining portion in the print head in FIG. 4 and the positions where ink dots are formed.

FIG. 6 schematically shows the relationship between the nozzles in the chips (N) and (N+1) and ink dots formed by ink droplets ejected from the nozzles. Non-overlapping nozzles (n) to (n+5) and (n+10) to (n+15) are consecutively supplied with the corresponding image data. The overlapping nozzles (n+6) and (n+8) are supplied with the corresponding image data so as to alternately eject ink. Likewise, the overlapping nozzles (n+7) and. (n+9) are supplied with the corresponding image data so as to alternately eject ink.

Figure 7:
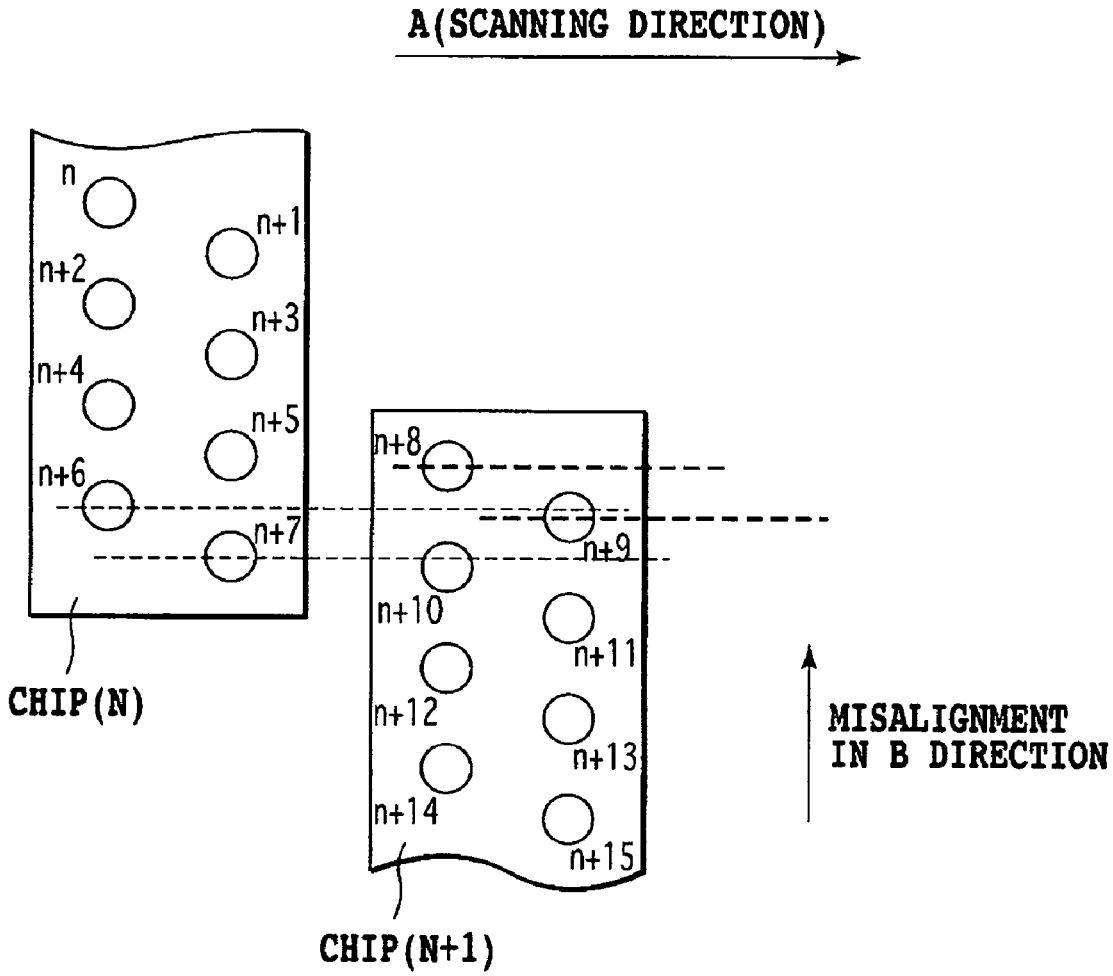
FIG. 7 is schematic diagram showing that misalignment occurs in the joining portion in the print head in FIG. 3.

FIG. 7 schematically shows arrangements in a print head configured similarly to that in FIG. 4 in which misalignment occurs between the chips.

Figure 8:
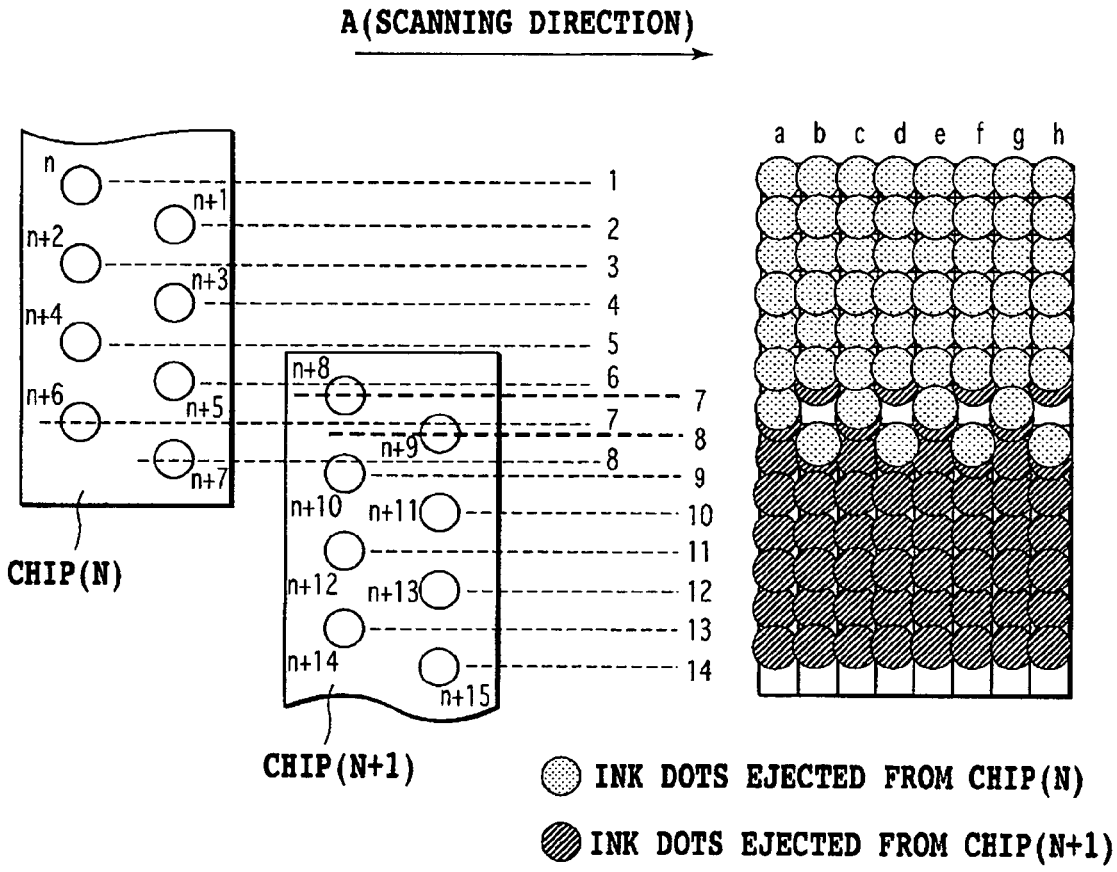
FIG. 8 is a diagram showing the relationship between the nozzles in the joining portion in the print head in FIG. 7 and the positions where ink dots are formed.

FIG. 7 shows an example in which misalignment occurs between the chips (N) and (N+1) to reduce the pitch between the nozzles (two nozzles) located at the overlapping position. If the image data is supplied as is the case with FIG. 6 in spite of this misalignment, ink dots are formed as shown in FIG. 8. Misalignment thus occurs in the image corresponding to the overlapping portion. Visual inspection of the actually printed image showed that the joining portion in the image corresponding to the overlapping portion was noticeable. Density unevenness was observed in the joining portion as a stripe or a moire fringe.

The present embodiment thus selects nozzles used to form an image of the overlapping portion, in view of the misalignment between the chips. The present embodiment then uses the selected nozzles to form dots.

First, description will be given of a method for determining the misalignment between the chips.

Figure 9:
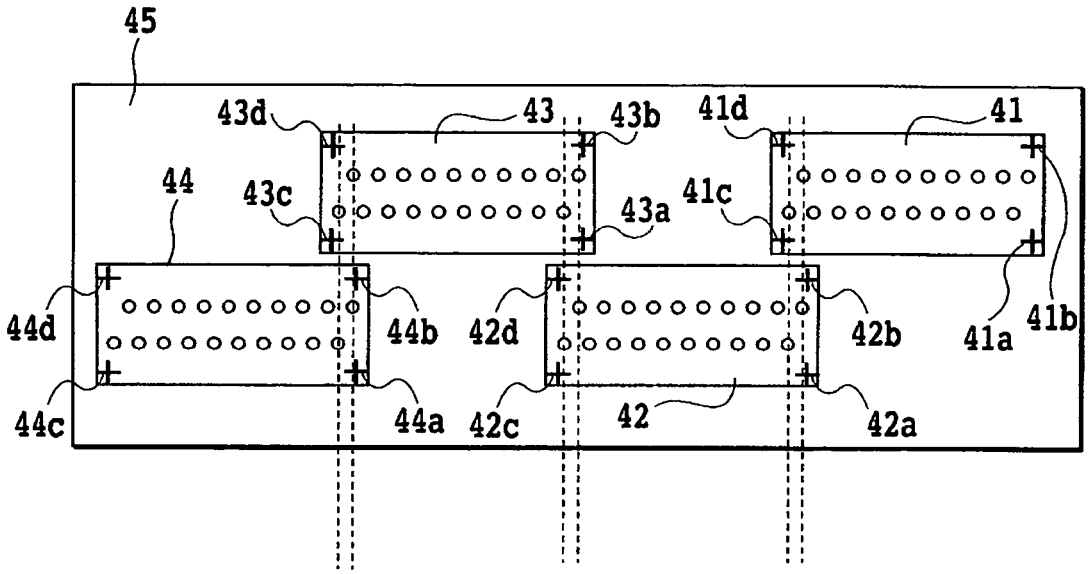
FIG. 9 is a diagram illustrating a method for measuring the precision of the arrangement in each joining portion in the print head in FIG. 2.

FIG. 9 illustrates the configuration of the print head in which the chips 41 to 44 are staggered as is the case with FIG. 2. Alignment marks (41*a*, 41*b*, 41*c*, 41*d*, . . . 44*c*, 44*d*) are provided in the four corners of each of the chips 41 to 44; the alignment marks are used as references to align the chips with one another. The coordinates of the alignment marks are detected to measure the absolute and relative positions of the chips 41 to 44. The alignment marks are also used for a process of manufacturing nozzles or heaters on the chips. However, alignment marks different from those for the manufacture process may be used for the measurement. Any alignment marks can be used provided that they enable reference positions to be accurately determined when the chips are arranged.

Figure 10:
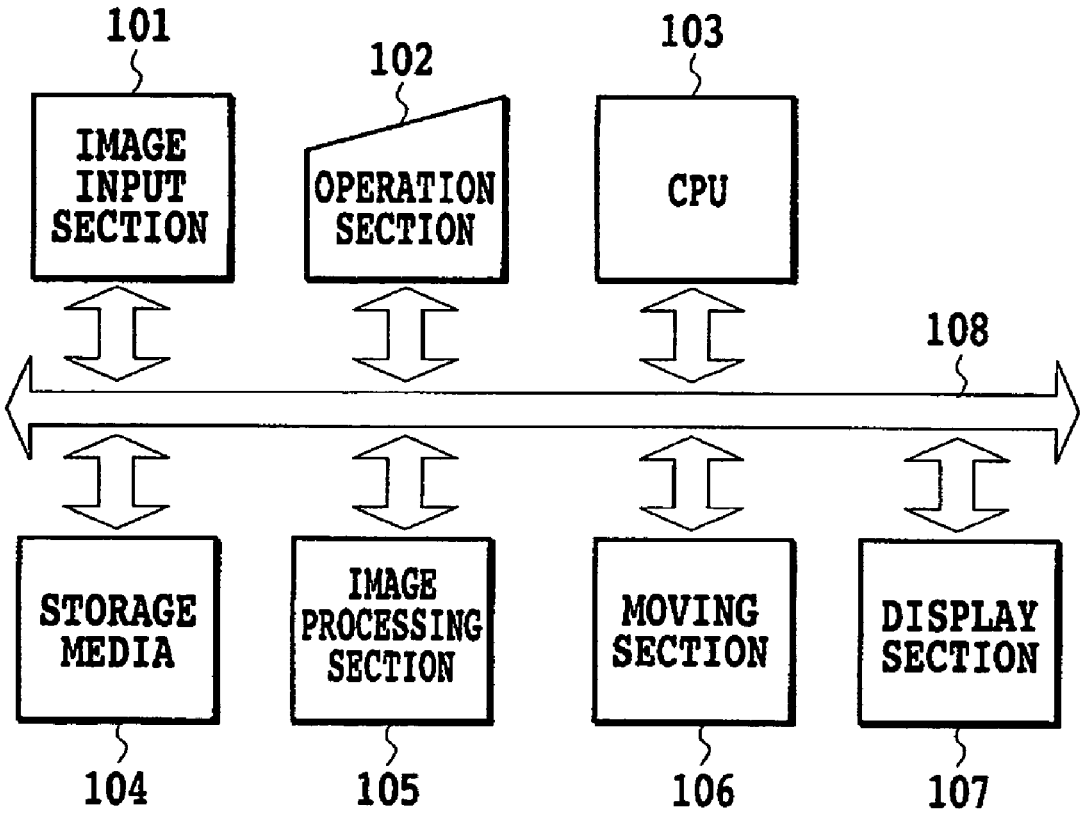
FIG. 10 is a block diagram of a control system for detecting means used for the measuring method shown in FIG. 9.

FIG. 10 is a block diagram of a control system for measuring means for measuring the positions of the alignment marks. In FIG. 10, reference numerals 101, 102, and 103 denote an image input section, an operation section, and a CPU that executes various processes, respectively. Reference numerals 104 and 105 denote storage media that stores various measurement data and an image processing section, respectively. Reference numerals 106, 107, and 108 denote a moving section that moves the image input section 101 to a predetermined position, a display section, and a bus section that transfers various data, respectively.

The image input section 101 is image input equipment such as a CCD camera through which image data on the chips such as the one shown in FIG. 9 is loaded. The image data is displayed on the display section 107 such as a monitor. The operation section 102 comprises various keys used to give instructions on the following operations: setting various parameters, moving the image input section 101 to a predetermined position, and starting of inputting images and measurement. The CPU 103 controls the entire measuring means in accordance with control programs in the storage media 104. The storage media 104 stores control programs and error processing programs in order to operate the measuring means in the present example in accordance with these programs. The storage media 104 may be a RAM, an FD, an HD, a memory card, a magneto optic disk, or the like.

The image processing section 105 displays image data on a chip loaded through the image input section 101. The image processing section 105 further detects, in the image data on the chip, alignment marks such as those shown in FIG. 9. The image processing section 105 then carries out, for example, copying of the detection result to an internal memory. The image processing section 105 subsequently processes the image while referencing a preset chip image. The image processing section 105 then converts the processing result into coordinates corresponding to positional information on the chip. The CPU 103 sequentially stores the coordinates of the chip obtained by the conversion by the image processing section 105, in the storage media 104. The CPU 103 then causes the moving section 106 in the form of a stage or the like to move the image input section 101 to the measurement position of the next chip.

This operation is performed on all chips and coordinate information on these chips is stored in the storage media 104. On the basis of the coordinate information on these chips, the CPU 103 subsequently calculates the absolute and relative positions of each of the chips. The CPU 103 then stores the calculations in the storage media as data on the misalignment between the chips.

In the chips (N) and (N+1), originally, the nozzles (n+6) and (n+8) overlap, while the nozzles (n+7) and (n+9) overlap, as shown in FIGS. 4 and 6. If misalignment occurs between the chips (N) and (N+1) as shown in FIGS. 7 and 8, the measuring means configured as shown in FIG. 10 detects that the chip (N+1) is misaligned with respect to the chip (N) by a distance corresponding to about one nozzle in the direction of an arrow B in FIG. 7. On the basis of data on the measured amount of misalignment, a combination of nozzles used to form an image of the overlapping portion is changed.

Figure 11:
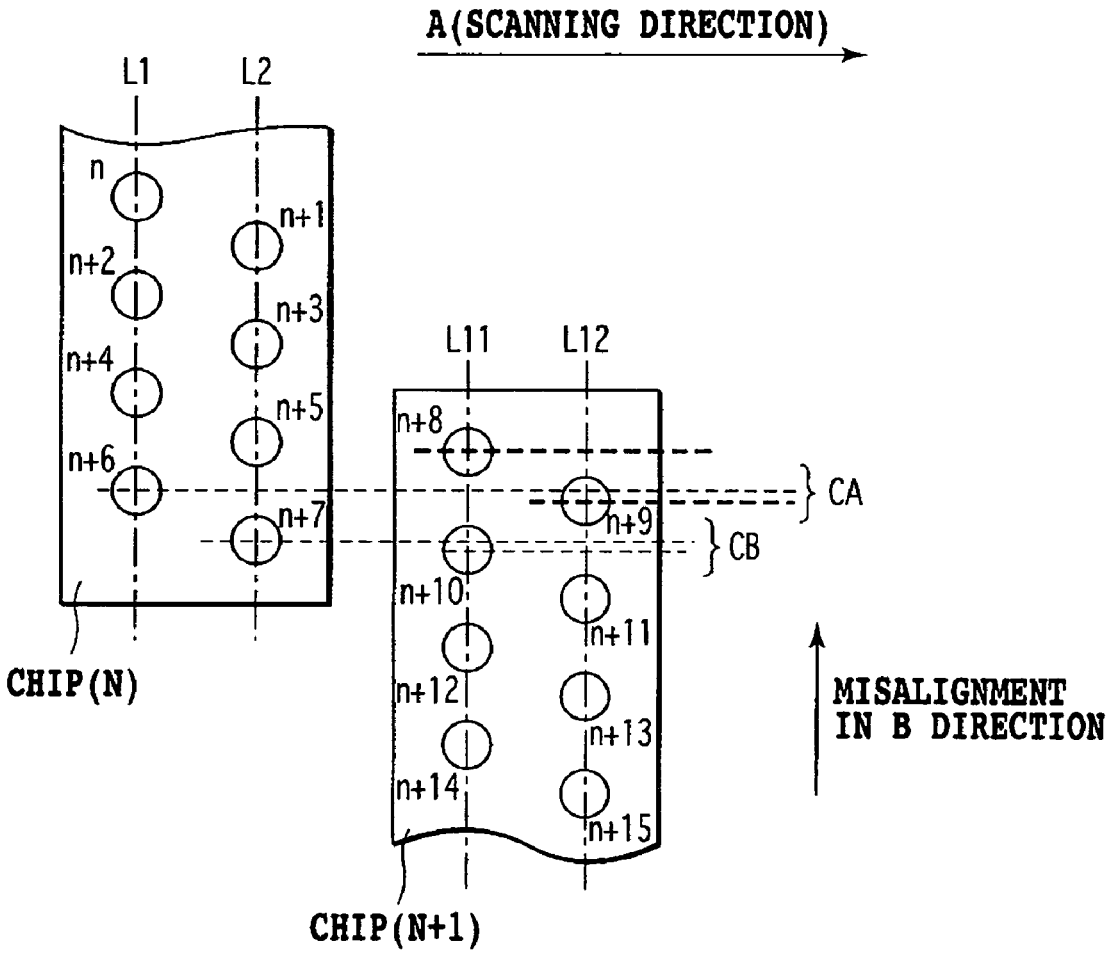
FIG. 11 is a diagram illustrating an example of misalignment in a joining portion in the print head which has been measured by the measuring method in FIG. 9.

First, a combination of a nozzle line group on the chip (N) and a nozzle line group on the chip (N+1) is found in which only slight misalignment occurs in the nozzle overlapping portion. In FIG. 11, the following are found: a combination of a nozzle line group L2 in which nozzles (n+5) and (n+7) are located and a nozzle line group L11 in which the nozzles (n+8) and (n+10) are located, and a combination of a nozzle line group L1 in which a nozzle (n+6) is located and a nozzle line group L12 in which nozzle (n+9) is located.

An image is formed by modifying image data supplied to the nozzles depending on the combinations of the nozzle line groups.

Figure 12:
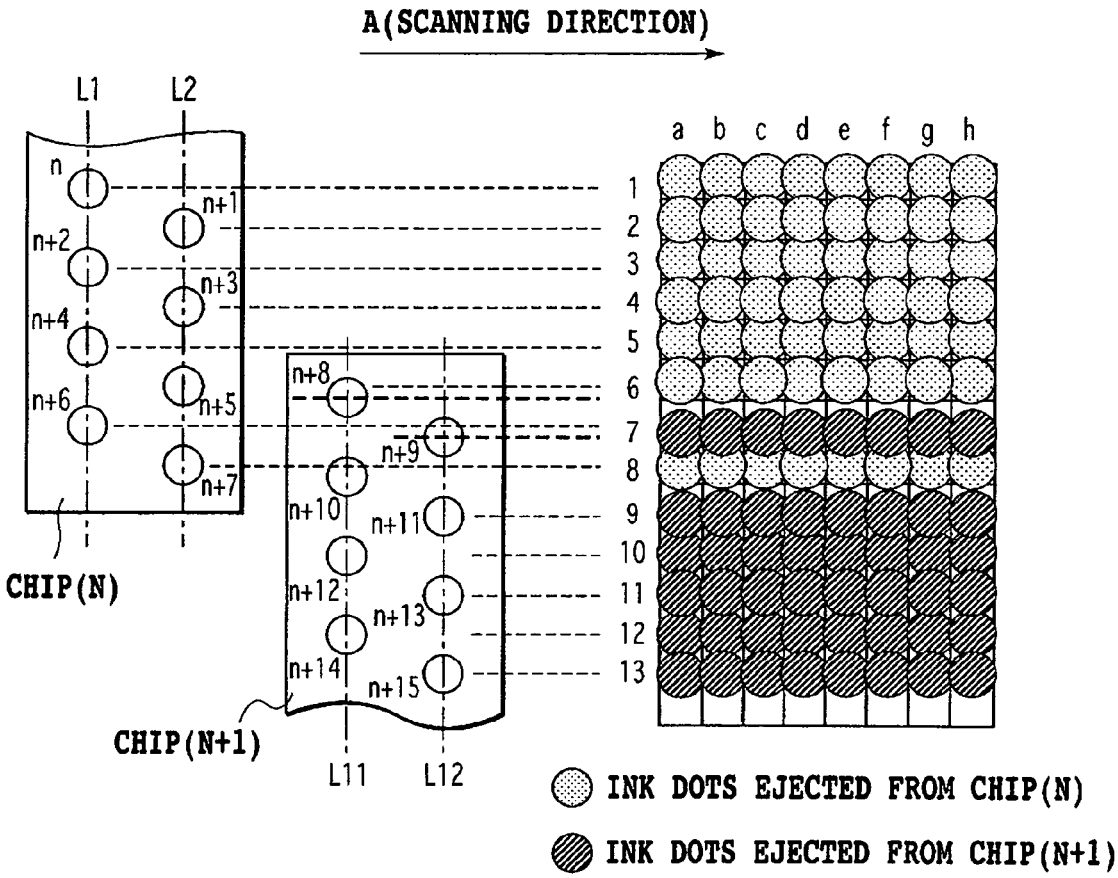
FIG. 12 is a diagram showing the relationship between the nozzles in the joining portion in the print head in FIG. 11 and the positions where ink dots are formed.

FIG. 12 is a diagram illustrating that ink dots have been formed by allowing the nozzle line groups L2 and L12 to eject ink droplets. In the present example, ink dots on print lines 1 to 6 are formed using nozzles (n) to (n+5). Ink dots on a print line 7 are formed using the nozzle (n+9). Ink dots on a print line 8 are formed using the nozzle (n+7). Ink dots on print lines 9 to 13 are formed using nozzles (n+11) to (n+15). The nozzles (n+6), (n+8), and (n+10) are not used.

The ink dots thus formed make the resulting image appear continuous by making the joining portions unnoticeable. Visual inspection of the print result showed that the joining portions were unnoticeable. Density unevenness in the form of a stripe or a moire fringe was not observed.

Second Embodiment

Figure 13:
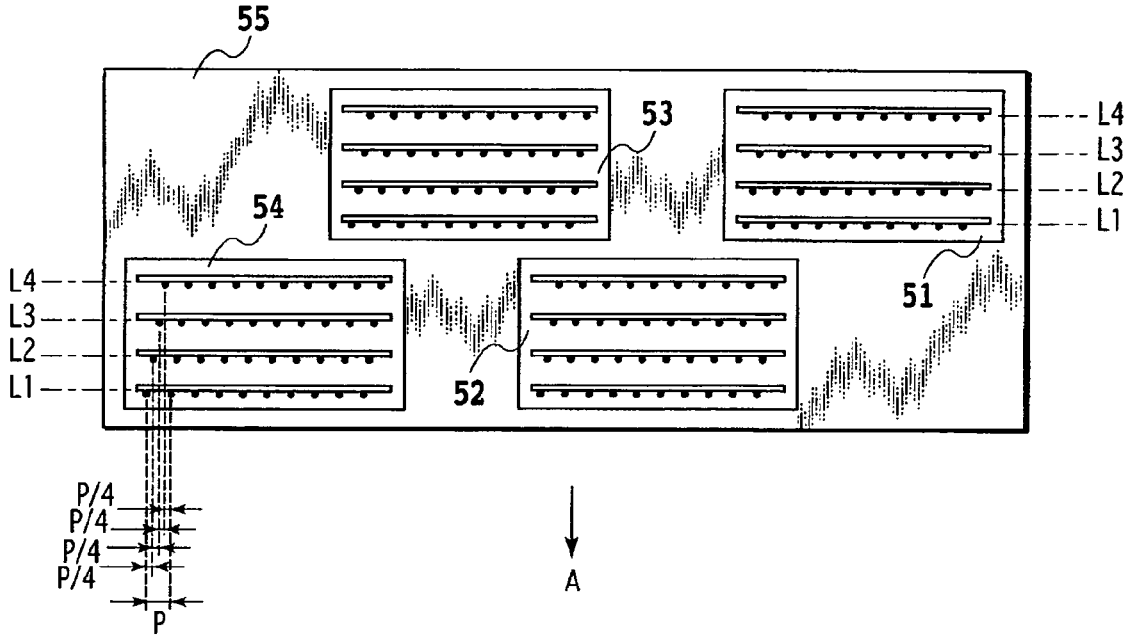
FIG. 13 is a schematic diagram of a full-multi type long print head used in a second embodiment of the present invention.

FIG. 13 shows an example of configuration of a full-multi type long print head used for a second embodiment of the present invention. In the present example, a print head includes a plurality of (in FIG. 13, four) short chips 51, 52, 53, and 54 each having four nozzle lines (L1, L2, L3, and L4). The chips 51, 52, 53, and 54 are staggered in the direction of the nozzle lines, thus constituting a long nozzle group unit 55. In each of the nozzle line groups L1 to L4, the pitch P between the nozzles is 600 dpi (about 42.4 μm). The nozzles in each of the nozzle line groups L1 to L4 are offset from the corresponding nozzles in the adjacent nozzle line group, by a P/4 pitch (2,400 dpi). In each of the joining portions among the four chips 51 to 54, two nozzles in each of the nozzle line groups L1 to L4, that is, a total of eight nozzles in the nozzle line groups L1 to L4, overlap one another.

Alignment marks serving as reference positions are provided in the four corners of each of the chips 51 to 54 as is the case with FIG. 9, previously described. The alignment marks can also be used for a process of manufacturing nozzles or heaters on the chips 51 to 54. Measuring means similar to that in FIG. 10, previously described, detects the coordinate positions of the alignment marks. On the basis of the detection data, the absolute and relative positions of the chips 51 are calculated and saved as information on the misalignment among the chips 51 to 54.

Figure 14:
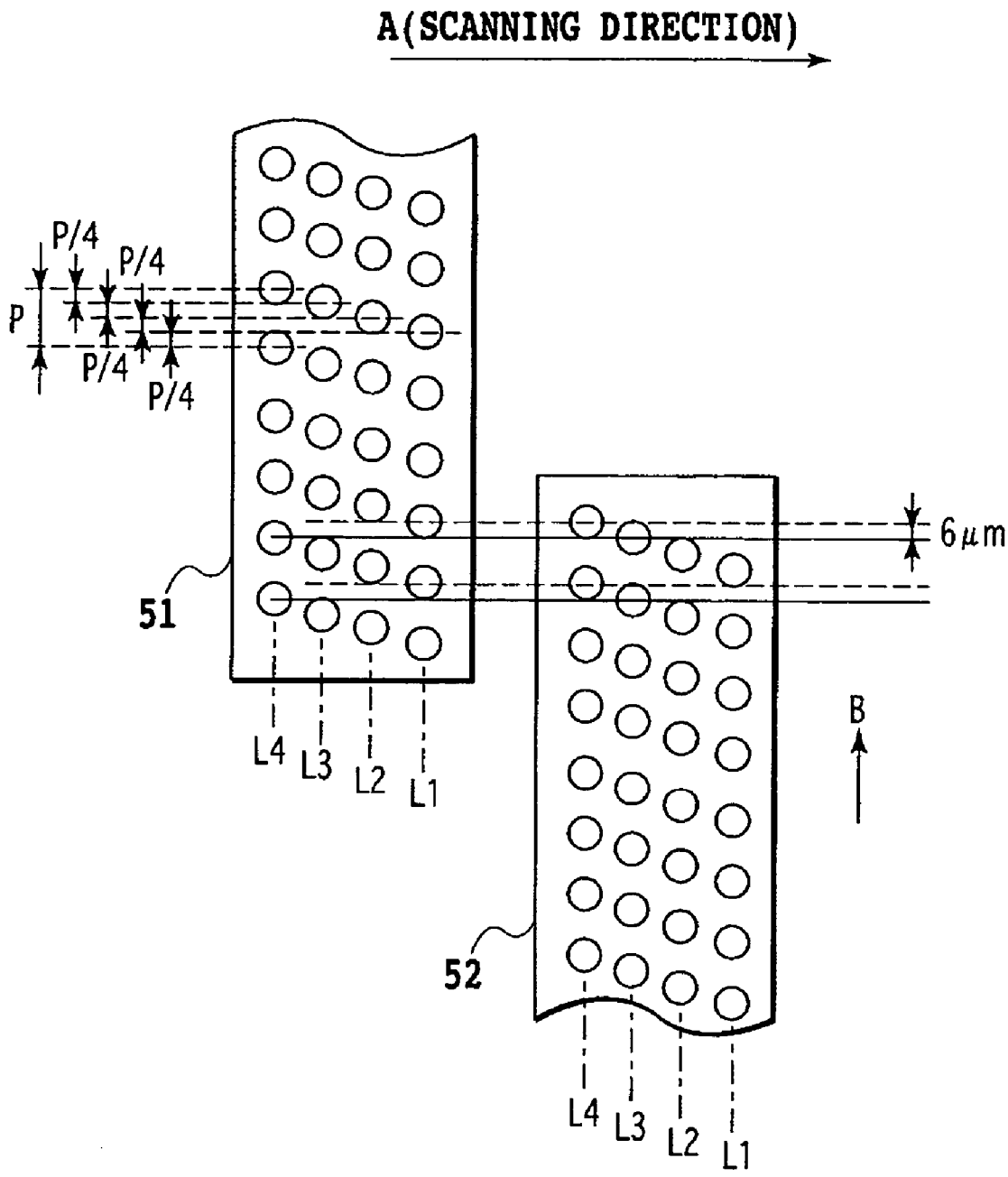
FIG. 14 is a schematic diagram of a joining portion in the print head in FIG. 13 in which misalignment is occurring.
Figure 15:
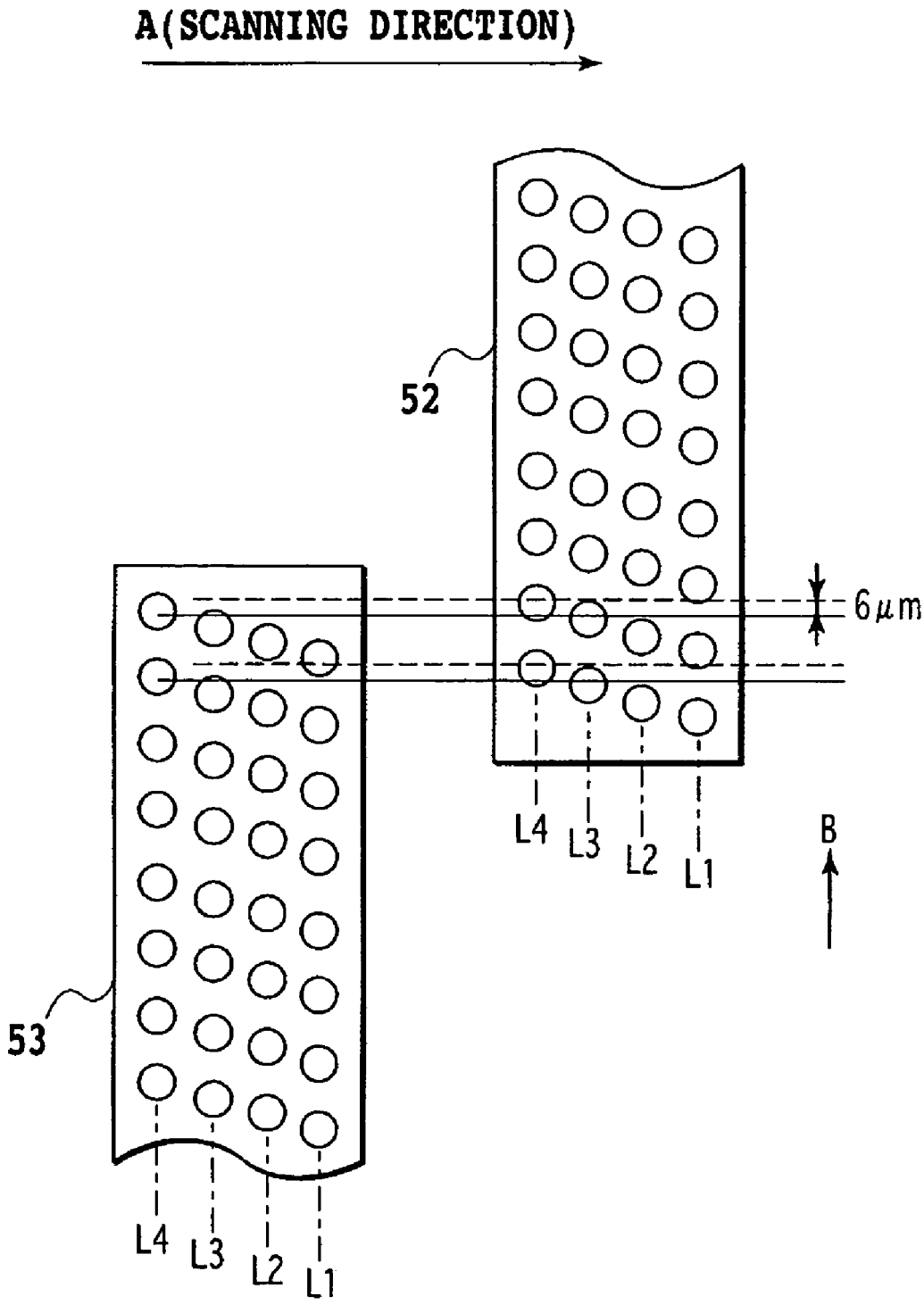
FIG. 15 is a schematic diagram of another joining portion in the print head in FIG. 13 in which misalignment is occurring.

FIGS. 14 and 15 are schematic diagrams showing that the measurement of the misalignment among the chips indicates that the chip 52 is misaligned with respect to the chips 51 and 53 by 6 μm in a B direction. In this case, the interval between the nozzles in the joining portion between the nozzles 51 and 52 is smaller than the original one. On the other hand, the interval between the nozzles in the joining portion between the nozzles 52 and 53 is larger than the original one.

In the present example, nozzle line groups used to form an image at a resolution of 1,200 dpi are selected in view of the amount of misalignment between the nozzles in the joining portion between the chips.

Originally, in the joining portion between the chips 51 and 52, the nozzle groups L1 to L4 in the chip 51 correspond to the nozzle groups L1 to L4 in the chip 52. In the joining portion between the chips 52 and 53, the nozzle groups L1 to L4 in the chip 52 correspond to the nozzle groups L1 to L4 in the chip 53. However, if the measurement of the misalignment between the nozzles is as shown in FIGS. 14 and 15, the following have the smallest amount of misalignment in the joining portion between the chips 51 and 52: a combination of the nozzle line group L4 in the chip 51 and the nozzle line group L3 in the chip 52 and a combination of the nozzle line group L2 in the chip 51 and the nozzle line group L1 in the chip 52. The following have the smallest amount of misalignment in the joining portion between the chips 52 and 53: a combination of the nozzle line group L3 in the chip 52 and the nozzle line group L4 in the chip 53 and a combination of the nozzle line group L1 in the chip 52 and the nozzle line group L2 in the chip 53.

Figure 16:
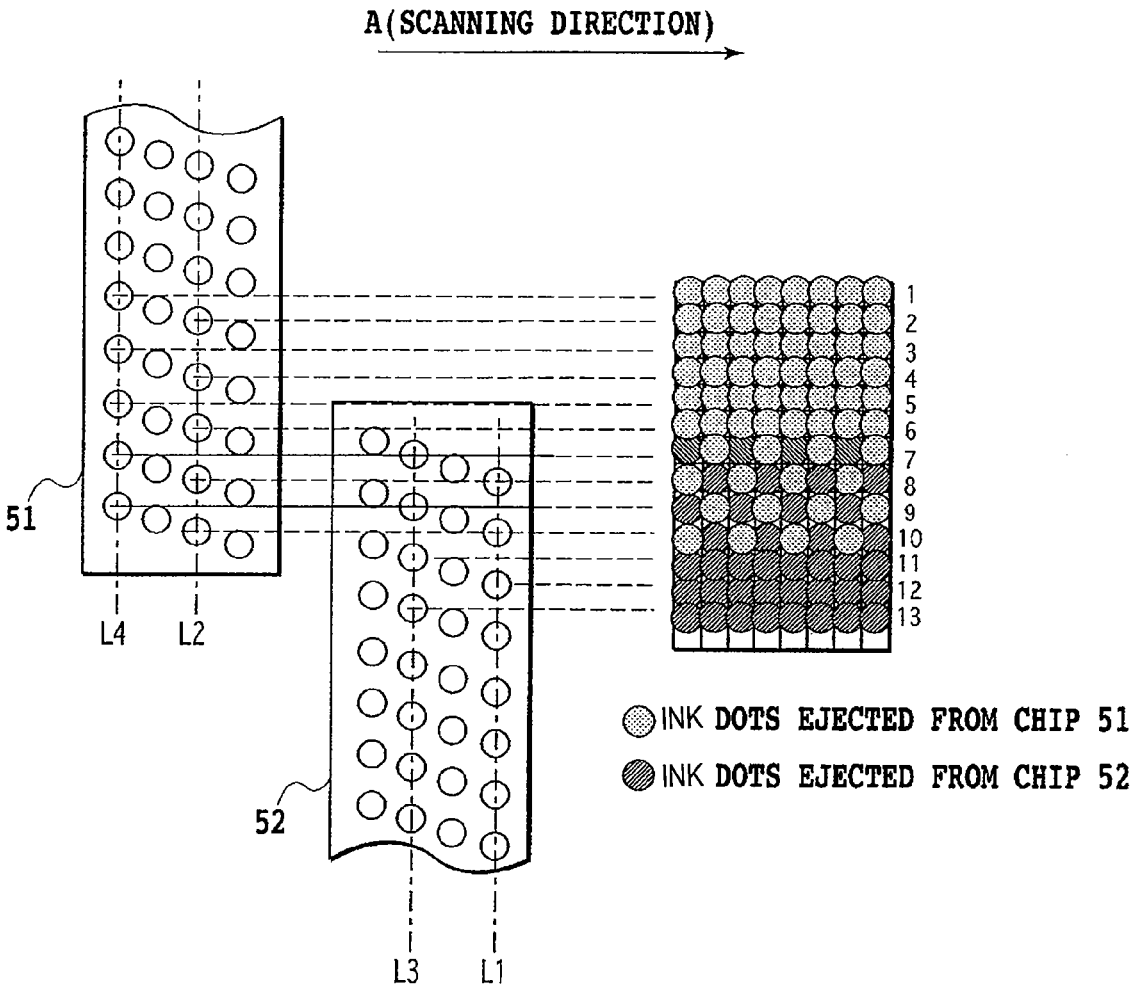
FIG. 16 is a diagram showing the relationship between the nozzles in the joining portion in the print head in FIG. 14 and the positions where ink dots are formed.
Figure 17:
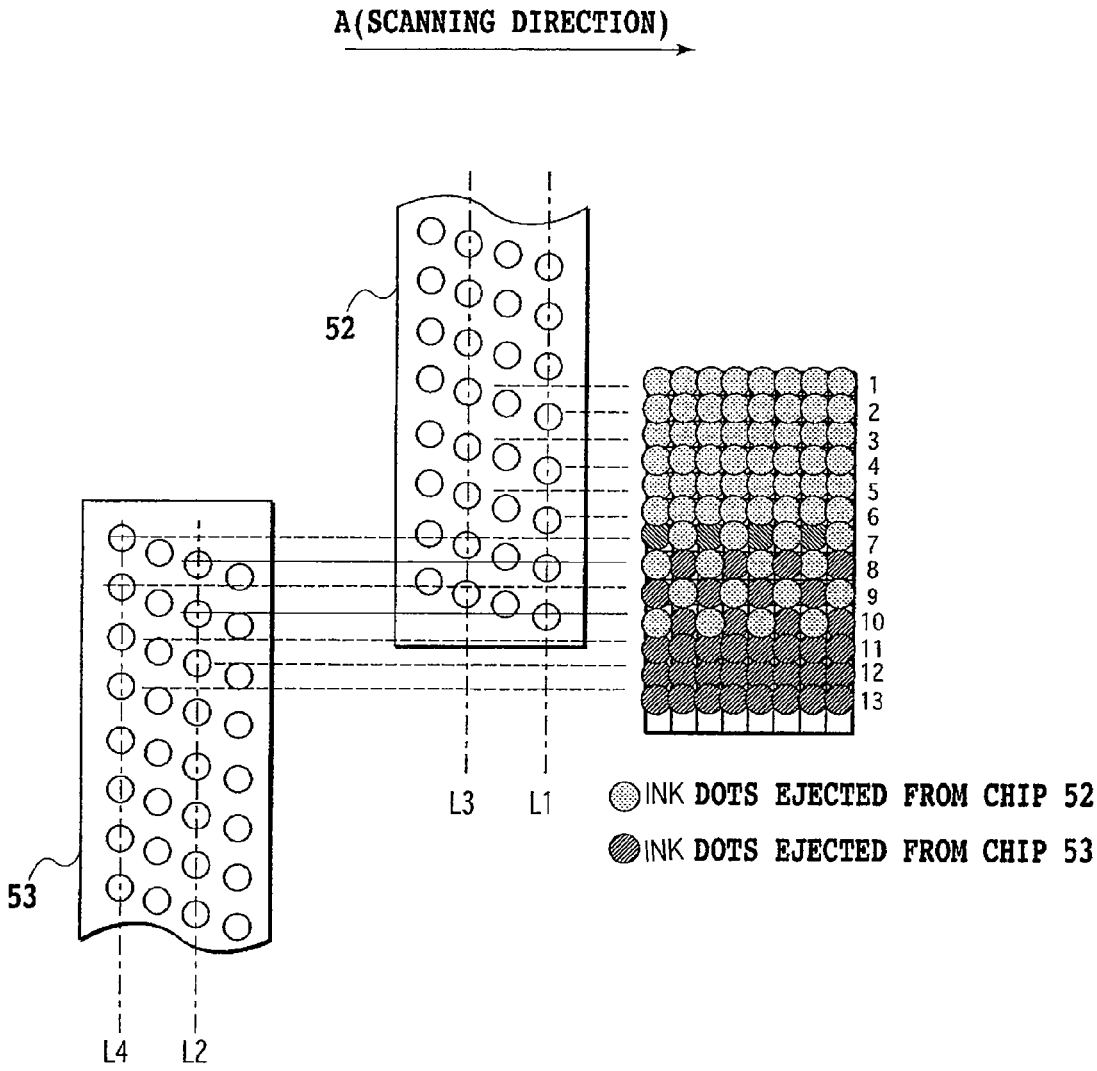
FIG. 17 is a diagram showing the relationship between the nozzles in the joining portion in the print head in FIG. 15 and the positions where ink dots are formed.

FIGS. 16 and 17 are schematic diagrams showing that ink dots have been formed by allowing ink to be ejected from the above combinations of nozzle line groups. Specifically, the ink dots have been formed by allowing the ink to be ejected from the nozzle line groups L2 and L4 in the chip 51, the nozzle line groups L1 and L3 in the chip 52, and the nozzle line groups L2 and L4 in the chip 53.

More specifically, in FIG. 16, ink dots on print lines 1, 3, and 5 are formed by using the nozzle line group L4 in the chip 51. Ink dots on print lines 2, 4, and 6 are formed by using the nozzle line group L2 in the chip 51. Ink dots on print lines 7 and 9 are formed by alternately using the nozzle line group L4 in the chip 51 and the nozzle line group L3 in the chip 52. Ink dots on print lines 8 and 10 are formed by alternately using the nozzle line group L2 in the chip 51 and the nozzle line group L1 in the chip 52. Ink dots on print lines 11 and 13 are formed by using the nozzle line group L3 in the chip 52. Ink dots on a print line 12 are formed by using the nozzle line group L1 in the chip 52. Similarly, in FIG. 17, ink dots on print lines 1, 3, and 5 are formed by using the nozzle line group L3 in the chip 52. Ink dots on print lines 2, 4, and 6 are formed by using the nozzle line group L1 in the chip 52. Ink dots on print lines 7 and 9 are formed by alternately using the nozzle line group L3 in the chip 52 and the nozzle line group L4 in the chip 53. Ink dots on print lines 8 and 10 are formed by alternately using the nozzle line group L1 in the chip 52 and the nozzle line group L2 in the chip 53. Ink dots on print lines 11 and 13 are formed by using the nozzle line group L4 in the chip 53. Ink dots on a print line 12 are formed by using the nozzle line group L2 in the chip 53.

The ink dots thus formed make the resulting image appear continuous by making the joining portions unnoticeable. Moreover, in the nozzle overlapping portion, that is, in the area containing the print lines 7 to 10 in FIGS. 16 and 17, ink is alternately ejected from the nozzles in the adjacent chips to make the joining portion more unnoticeable. To selectively use any of the nozzle line groups in each chip, it is possible to determine combinations of nozzle line groups as described above and then to associate the nozzle line groups with the image data.

Other Embodiments

Figure 18:
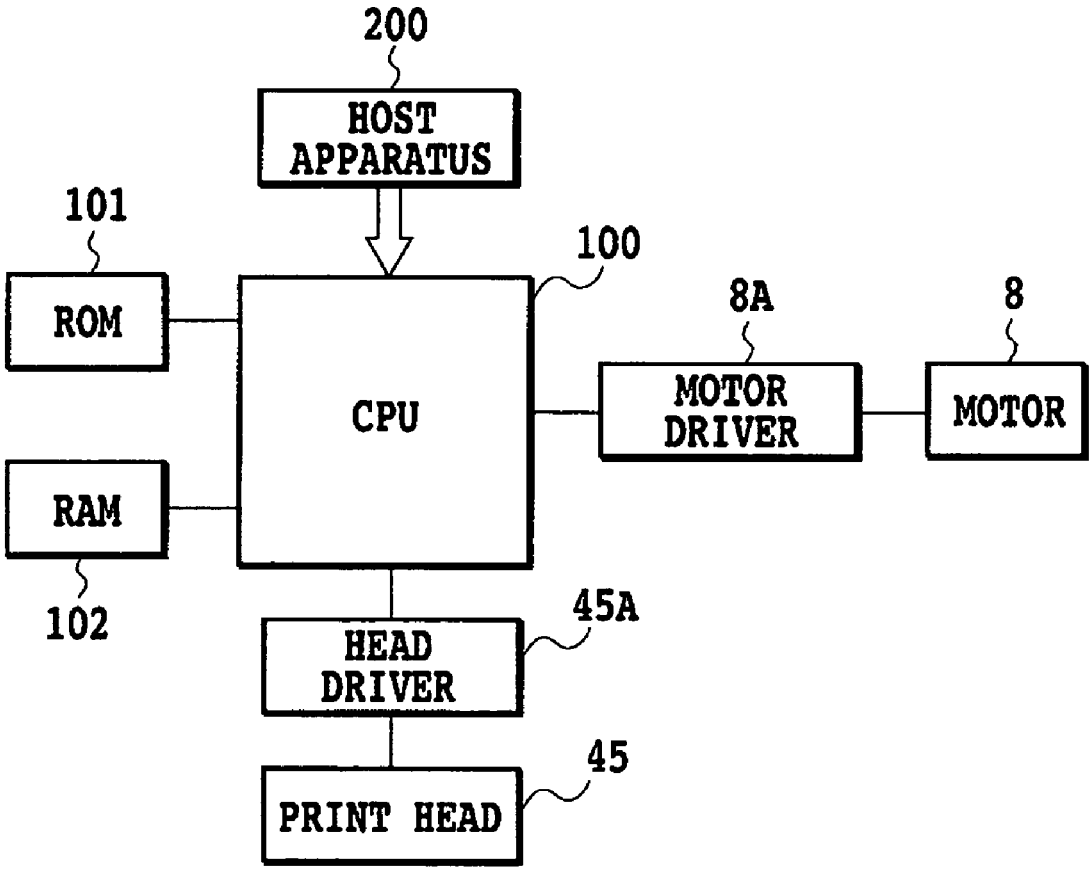
FIG. 18 is a block diagram illustrating an example of a control system in an ink jet printing apparatus in accordance with the present invention.

FIG. 18 is a block diagram illustrating an example of a control system in the ink jet printing apparatus.

In FIG. 18, a CPU 100, for example, controls operations of the printing apparatus and processes data. A ROM 101 stores programs for the procedures of the processes executed by the CPU 100. A RAM 102 is used as a work area for executing these processes. Ink is ejected from the print head 45 by the CPU 100 by supplying a head driver 45A with drive data (image data) and drive control signals (heat pulse signals) for the heating elements (electrothermal converters). The CPU 100 controls the drive motor 8 via a motor driver 8A to convey the print media 5 in the direction of the arrow A as shown in FIG. 1.

The CPU 100 functions as control means for using nozzles selected on the basis of the amount of misalignment between the chips, as overlapping nozzles to print images corresponding to the joining portions. The CPU 100 may also function as selecting means for selecting overlapping nozzles on the basis of the amount of misalignment between the chips. In this case, storage means that can store information on the amount of misalignment between the chips is provided in the print head or printing apparatus so that overlapping nozzles can be selected on the basis of the information stored in the storage means.

By thus selecting overlapping nozzles on the basis of the information stored in the storage means, it is possible to simplify image processing including a process of associating the nozzles with the image data. The information includes at least measurement data on the amount of misalignment between the chips in the nozzle arranging direction. Such measurement data can be obtained by reading the alignment marks during the manufacture of the print head and measuring the misalignment in a horizontal, vertical, and rotating directions after the chips have been arranged, as is the case with the previously described embodiment.

The functions of the control means and selecting means can be provided not only for the CPU 100 but also for a host apparatus 200. These functions have only to be achieved by the computer in accordance with the appropriate programs.

Other Embodiments

The present invention is effectively applicable to a printing apparatus using a print head based on an ink jet printing scheme, particularly an ink jet scheme of carrying out printing by utilizing thermal energy to eject droplets.

For the typical configuration and principle of the ink jet scheme, it is preferable to use the basic principle disclosed in, for example, U.S. Pat. Nos. 4,723,129 and 4,740,796. This scheme is applicable to both the on demand type and the continuous type. For the on demand type, at least one drive signal is applied to the electrothermal converters to rapidly raise the temperature in accordance with print information so that the temperature exceeds one corresponding to nucleate boiling; the electrothermal converters are placed in association with sheets or liquid paths holding a liquid (ink). Each electrothermal converter thus generates thermal energy to cause film boiling in the liquid (ink) present on a heat acting surface of the print head. This makes it possible to form bubbles corresponding to the drive signal, in the liquid (ink). The growth and shrinkage of the bubbles causes the liquid (ink) to be ejected through the appropriate ejection opening to form at least one droplet. The pulse shape of the drive signal is preferable in achieving responsive ejection of the liquid (ink) because it allows the bubbles to grow and shrink immediately and properly. Suitable pulse-shaped drive signals are described in U.S. Pat. Nos. 4,463,359 and 4,345,262. U.S. Pat. No. 4,313,124 describes an invention relating to the rate at which the temperature of the heat acting surface increases. Printing can be more excellently achieved by employing the conditions described in this patent.

The configuration of the print head is not limited to the combination (linear or right-angle liquid channel) of ejection openings, liquid paths, and electrothermal converters as disclosed in the above specifications. The present invention includes a configuration in which the heat acting portion is placed in a bent area as disclosed in U.S. Pat. Nos. 4,558,333 and 4,459,600.

The present invention can also be effectively implemented by using a slit as a common ejecting portion for a plurality of electrothermal converters as disclosed in Japanese Patent Application Laid-Open No. 59-123670. The present invention can also be effectively implemented by using an opening that absorbs the pressure wave of thermal energy, as an ejecting portion as disclosed in Japanese Patent Application Laid-Open No. 59-138461. That is to say, the present invention can carry out printing both reliably and efficiently regardless of the form of the print head.

The present invention is also effective not only on a full line type print head having a length corresponding to the maximum width of a print material over which the printing apparatus can print images but also on the above serial type print head. The present invention is effective even if various forms of print heads are used. One form of print head is fixed to the apparatus main body. Another form of print head is of a replaceable chip type that is installed in the apparatus main body so that it can be electrically connected to the apparatus main body or supplied with ink from the apparatus main body. Another form of print head is of a cartridge type that is integrated with ink tank.

It is preferable to add ejection recovery means for allowing the print head to maintain proper ejections as well as preliminary auxiliary means as components of the printing apparatus in accordance with the present invention. This enables the effects of the present invention to be further stabilized. Specific examples of these means include capping means and cleaning means for the print head. Another example is means for discharging ink not contributing to printing images, from the print head by means of pressurization or suction. Another example is preliminary ejecting means for ejecting ink not contributing to printing images, independently of printing. Another example is preliminary heating means for heating the print head using electrothermal converters, other heating elements, or their combination.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-164451 filed Jun. 3, 2005, which is hereby incorporated by reference herein.

What is claimed is:

1. An ink jet printing apparatus that prints an image by using an ink jet print head having first and second chips, each comprising a plurality of nozzles which are arranged so as to be equally spaced in a nozzle arranging direction and from which ink can be ejected, the first and second chips being arranged so that end portions of the first and second chips overlap each other in a moving direction crossing the nozzle arranging direction to form a joining portion, overlapping nozzles located in a side of the first chip and a side of the second chip of the joining portion being overlapped with respect to each other in the moving direction, relative movement between the ink jet print head and a print medium being effected in the moving direction, the apparatus comprising:

a mark provided on each of the first and second chips, the mark being provided at a position common to the first and second chips; and control means for printing an image corresponding to the joining portion of the first and second chips by using the overlapping nozzles, a combination of nozzles located in the first chip side and the second chip side of the joining portion being selected as the overlapping nozzles on the basis of an amount of misalignment among the first and second chips in the nozzle arranging direction, the amount of misalignment being specified on the basis of the marks provided on the first and second chips, wherein a combination of nozzles having the smallest amount of misalignment is selected as the overlapping nozzles, and wherein the combination of nozzles selected as the overlapping nozzles is used to print an image on the same line in the moving direction.

2. The ink jet printing apparatus according to claim 1, wherein the control means uses one of the overlapping nozzles to print the image on the same line.

3. The ink jet printing apparatus according to claim 1, wherein the control means complementarily uses at least two of the overlapping nozzles to print the image on the same line.

4. The ink jet printing apparatus according to claim 1, wherein a plurality of the nozzle lines are formed in each of the first and second chips, and the combination of nozzles selected as the overlapping nozzles is included in nozzle lines having the smallest amount of misalignment.

5. The ink jet printing apparatus according to claim 4, wherein the nozzles in each of the plurality of nozzle lines are dislocated with respect to each other in the nozzle arranging direction.

6. The ink jet printing apparatus according to claim 4, wherein the control means prints an image on the print medium using the nozzle lines including the overlapping nozzles.

7. The ink jet printing apparatus according to claim 1, further comprising selecting means for selecting the combination of nozzles as the overlapping nozzles on the basis of the amount of misalignment among the first and second chips.

8. The ink jet printing apparatus according to claim 7, further comprising storage means capable of storing information on the amount of misalignment among the first and second chips, and the selecting means selects the combination of nozzles as the overlapping nozzles on the basis of the information stored in the storage means.

9. The ink jet printing apparatus according to claim 8, wherein the information includes at least measurement data on the amount of misalignment among the first and second chips in the nozzle arranging direction.

10. The ink jet printing apparatus according to claim 7, wherein the ink jet print head comprises storage means capable of storing information on the amount of misalignment among the first and second chips, and the selecting means selects the combination of nozzles as the overlapping nozzles on the basis of the information stored in the storage means.

11. An ink jet printing method of printing an image by using an ink jet print head having first and second chips, each comprising a plurality of nozzles which are arranged so as to be equally spaced in a nozzle arranging direction and from which ink can be ejected, the first and second chips being arranged so that the end portions of the first and second chips overlap each other in a moving direction crossing the nozzle arranging direction to form a joining portion, overlapping nozzles located in a side of the first chip and a side of the second chip of the joining portion being overlapped with respect to each other in the moving direction, relative movement between the ink jet print head and a print medium being effected in the moving direction, a mark provided on each of the first and second chips, the mark being provided at a position common to the first and second chips, the method comprising the step of:

printing an image corresponding to the joining portion of the first and second chips by using the overlapping nozzles, a combination of nozzles located in the first chip side and the second chip side of the joining portion being selected as the overlapping nozzles on the basis of an amount of misalignment among the first and second chips in the nozzle arranging direction, the amount of misalignment being specified on the basis of the marks provided on the first and second chips, wherein a combination of nozzles having the smallest amount of misalignment is selected as the overlapping nozzles, and wherein the combination of nozzles selected as the overlapping nozzles is used to print an image on the same line in the moving direction.

12. The ink jet printing method according to claim 11, further comprising selecting the combination of nozzles as the overlapping nozzles on the basis of the amount of misalignment among the first and second chips.

13. A method for setting print conditions for image printing carried out by using an ink jet print head having first and second chips, each comprising a plurality of nozzles which are arranged so as to be equally spaced in a nozzle arranging direction and from which ink can be ejected, the first and second chips being arranged so that the end portions of the first and second chips overlap each other in a moving direction crossing the nozzle arranging direction to form a joining portion, overlapping nozzles located in a side of the first chip and a side of the second chip of the joining portion being overlapped with respect to each other in the moving direction, relative movement between the ink jet print head and a print medium being effected in the moving direction, a mark provided on each of the first and second chips, the mark being provided at a position common to the first and second chips, the method comprising the step of:

setting, as the overlapping nozzles, a combination of nozzles located in the first chip side and the second chip side of the joining portion on the basis of an amount of misalignment among the first and second chips in the nozzle arranging direction, the amount of misalignment being specified on the basis of the marks provided on the first and second chips, wherein a combination of nozzles having the smallest amount of misalignment is selected as the overlapping nozzles, and wherein the combination of nozzles selected as the overlapping nozzles is used to print an image on the same line in the moving direction.

14. A computer-readable medium storing a program for setting print conditions for image printing carried out by using an ink jet print head having first and second chips, each comprising a plurality of nozzles which are arranged so as to be equally spaced in a nozzle arranging direction and from which ink can be ejected, the first and second chips being arranged so that end portion of the first and second chips overlap each other in a moving direction crossing the nozzle arranging direction to form a joining portion, overlapping nozzles located in a side of the first chip and a side of the second chip of the joining portion being overlapped with respect to each other in the moving direction, relative movement between the ink jet print head and a print medium being effected in the moving direction, a mark provided on each of the first and second chips, the mark being provided at a position common to the first and second chips, the program allowing a computer to execute:

a step of setting, as the overlapping nozzles, a combination of nozzles located in the first chip side and the second chip side of the joining portion on the basis of an amount of misalignment among the first and second chips in the nozzle arranging direction, the amount of misalignment being specified on the basis of the marks provided on the first and second chips, wherein a combination of nozzles having the smallest amount of misalignment is selected as the overlapping nozzles, and wherein the combination of nozzles selected as the overlapping nozzles is used to print an image on the same line in the moving direction.

* * * * *